US005307985A

United States Patent [19]

Beizermann

[11] Patent Number: 5,307,985

[45] Date of Patent: May 3, 1994

[54] CONTAINER AND PROCESS FOR ITS MANUFACTURE

[75] Inventor: Michel Beizermann, Voiron, France

[73] Assignee: Societe de Constructions de Materiel Metallique et Electrique, France

[21] Appl. No.: 986,424

[22] Filed: Dec. 4, 1992

[30] Foreign Application Priority Data

Dec. 17, 1991 [FR] France ..... 91 16082
Jun. 24, 1992 [FR] France ..... 92 08063

[51] Int. Cl.[5] ..... B65D 3/28

[52] U.S. Cl. ..... 229/120; 53/440; 206/439; 220/364; 426/118; 426/521

[58] Field of Search ..... 229/120, DIG. 14; 220/202, 203, 89.4, 361, 363, 364, 365, 374; 426/118, 521, 522; 206/439; 53/425, 440, 478

[56] References Cited

U.S. PATENT DOCUMENTS

| | | | |
|---|---|---|---|
| 1,133,999 | 3/1915 | Norton | 220/364 |
| 1,507,198 | 9/1924 | Nielsen | 220/366 |
| 1,544,384 | 6/1925 | Finn | 220/364 |
| 2,160,429 | 5/1939 | Bukolt | 220/364 |
| 2,595,708 | 5/1952 | Salfisberg | 426/118 |
| 3,428,236 | 2/1969 | Bidwell | 229/120 |
| 4,154,342 | 5/1979 | Wallace | 206/439 |
| 4,261,504 | 4/1981 | Cowan | 229/120 |
| 4,640,838 | 2/1987 | Isakson et al. | 229/DIG. 14 |
| 4,689,936 | 9/1987 | Gaikema et al. | 426/118 |
| 5,039,001 | 8/1991 | Kinigakis et al. | 229/120 |

FOREIGN PATENT DOCUMENTS

| | | | |
|---|---|---|---|
| 2331862 | 1/1975 | Fed. Rep. of Germany | 229/120 |

*Primary Examiner*—Gary E. Elkins
*Attorney, Agent, or Firm*—Pearne, Gordon, McCoy & Granger

[57] ABSTRACT

Vacuum-sealed container, including contents and having an upper part and an element integral with the upper part, a housing being defined by the upper part and by the element, containing a solid substance having a melting point between 65° and 150° and including a first orifice communicating with the container and a second orifice communicating with the exterior closed by the solid substance.

19 Claims, 2 Drawing Sheets

CONTAINER AND PROCESS FOR ITS MANUFACTURE

This invention relates to containers and a process for their manufacture. The invention relates particularly to containers used in the food industry, especially tins or boat-shaped receptacles, or "boats", but is also relates to any other container intended to contain articles which, following pasteurization or sterilization or some other heat treatment, must be protected from any risk of contamination.

By virtue of the container according to the invention, pasteurization and sterilization can be effected directly in the container presented to the consumer, without decantation or handling. The process for the manufacture of the container requires only relatively simple equipment, and no special apparatus is required when it is used during filling. The foods contained in the container are preserved better than hitherto, especially with respect to their colour.

The gastight container including contents according to the invention is characterized in that its upper part, together with an element integral therewith, defines a housing for receiving a solid substance having a melting point between 65° C. and 150° C., which communicates with the interior of the container by means of a first orifice and with the exterior by means of a second orifice closed by the solid substance.

The empty container, i.e. before filling then heating, is characterized in that its upper part, together with an element integral therewith, defines a housing for receiving a solid substance having a melting point between 65° C. and 150° C., which communicates with the interior of the container by means of a first orifice and with the exterior by means of a second orifice freed by the solid substance.

The process for the manufacture of this container consists in ensuring that a substance having a melting point between 65° C. and 150° C. is situated in a housing defined in the upper part of a container and communicating with the interior of the container by means of a first orifice and with the exterior by means of a second orifice, in heating the container and its housing to a temperature at least equal to the melting point of the substance for 5 to 90 minutes, then in cooling the substance to a temperature lower than its melting point more rapidly than the remainder of the container and its contents, then in cooling the remainder of the container and its contents to a temperature lower than or equal to the ambient temperature.

When the container and its housing are heated to a temperature higher than the melting point of the substance, the latter melts and the contents of the container release gases and steam which create excess pressure in the interior of the container with respect to the exterior. This excess pressure prevents the substance which has become liquid from penetrating into the interior of the container through the first orifice and forces the substance at least partially back into the second orifice. Nevertheless, the substance does not close the second orifice at this stage, so that the steam and the gases from the interior of the container can escape through this second orifice. This therefore means that it is possible to effect boiling, pasteurization or sterilization with no risk of explosion of the container. Once this heating has been completed, premature rapid localized cooling of the substance to a temperature lower than its melting point, while the remainder of the container and its contents remain essentially at the temperature to which they have just been brought, results in rapid solidification of the substance in the housing and in the second orifice, some of the substance moreover even forming a rim having a cross section greater than that of the second orifice at the outlet of the latter, so that the substance is virtually riveted to the container, thereby ensuring perfect sealing thereof. When the container and its contents are cooled to a temperature lower than or equal to the ambient temperature, e.g. to −4° C., or even to freezing point, the solid substance remains in place in the second orifice, containing to ensure sealing. By virtue of the container according to the invention and the process for its manufacture, it is therefore possible to close the tin in a sealed manner just after the gases and the steam which must escape therefrom have done so, this being effected automatically without requiring any kind of handling.

In order to ensure that the gases can escape through the second orifice during the heat treatment, such as pasteurization or sterilization, i.e. while the latter is beginning to be filled with the substance, it is very advantageous for the second orifice to have a circular cross section so that the substance begins to cover the inner wall thereof, beginning to leave towards the exterior while still leaving a passage for the gases and the steam. Good results are obtained to this end when the second orifice has a diameter between 0.7 and 2 mm.

The substance is, inter alia, a hot-melt adhesive used in a quantity of 10 to 100 mg according to the heat treatment temperature corresponding to pasteurization and sterilization or boiling. Hot-melt food adhesives can be used, inter alia, as the hot-melt adhesive, in the viscosities given hereinafter.

The substance preferably has a viscosity of approximately 6 Pas to 200 Pas at boiling point, at which viscosity it is best able to cover the second orifice without being completely expelled from the housing. To facilitate the effect obtained upon the localized cooling of the housing, the temperature interval between the melting point and the softening point of the substance is advantageously less than 15° C., and preferably greater than 7° C., so that as soon as the substance has cooled substantially with respect to the remainder of the container, it assumes an almost solid pasty state and cannot fall through the first orifice and contaminate the contents of the container as the pressure prevailing in the latter is still sufficient to push back the substance. The substance is preferably edible when the container is intended for the food industry. The container may be, inter alia, a tin, the housing preferably adjoining the lid and, inter alia, being formed on or under the later, or a boat, in which case the housing may then advantageously be formed on an edge of the body of the boat covered with a covering film. The element may be connected to or, if necessary, moulded in one piece with the container.

In the accompanying drawings, given purely by way of example:

Figure 1:
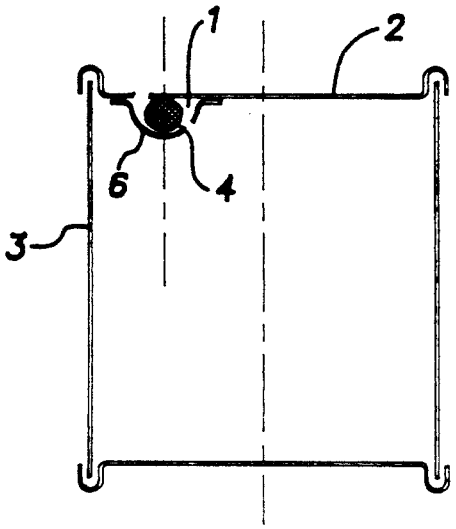
FIG. 1 is a vertical section of a metal tin with a housing obtained by swaging a separate metal plate.

The tin shown in FIG. 1 includes a body 3 closed in a sealed manner by a lid 2. The lid 2, together with a curved plate 6, defines a housing 1 for receiving 25 mg of a fusible resin 4 having a melting point of 110° C. The housing 1 communicates with the interior of the tin by means of a first orifice 7 having a section of 3 $mm^2$ and with the exterior by means of a second orifice 8. The latter has a circular cross section with a diameter of 1 mm. The viscosity of the substance 4 is 10 Pas at 110° C.

Figure 2:
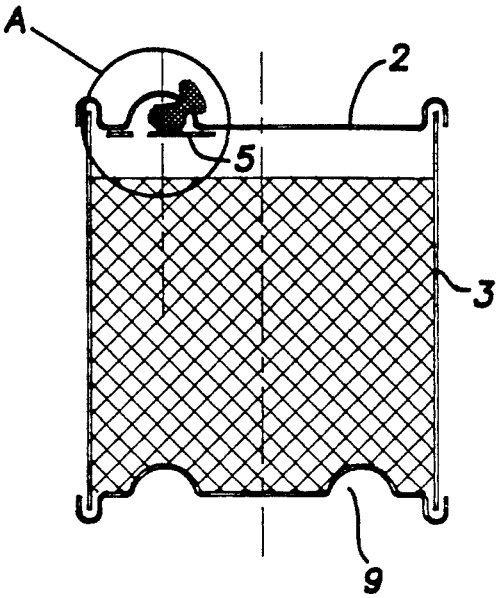
FIGS. 2 and 3 are analogous views of tins with housings formed by swaging the lid and by a flat metal plate, the tin of FIG. 2 being filled.
Figure 4:
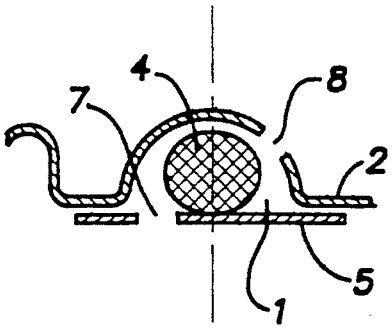
FIG. 4 is a view on a larger scale of the detail A from FIG. 2, before the tin is filled.

In FIGS. 2 and 4, the housing 1 is formed by a part of the lid 2 swaged so as to form a bulge and by a flat plate 5.

Figure 3:
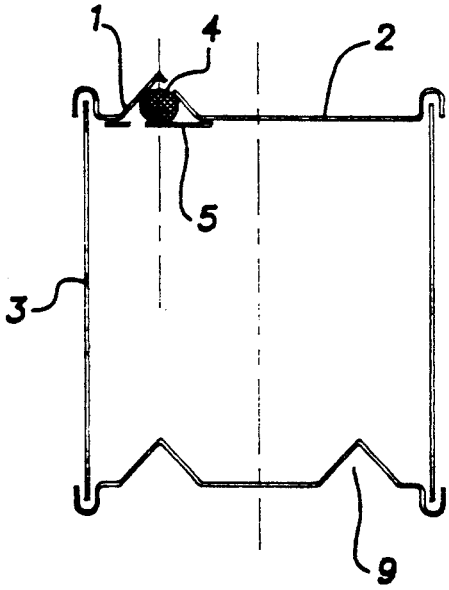

In FIG. 3, the housing 1 is formed by deformation of the lid by swaging and by a metal plate 5. A rib 9 formed in the base of the tin and corresponding to the part of the lid deformed by swaging allows two tins to be stacked one on top of the other.

Figure 5:
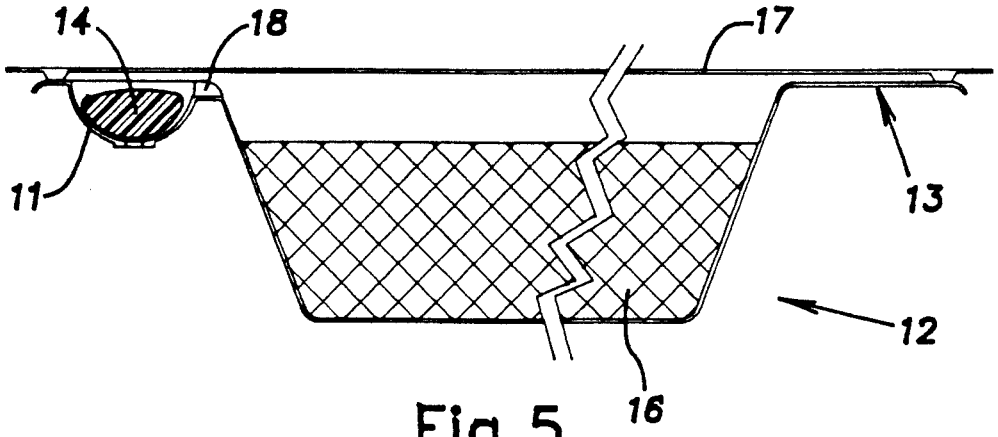
FIG. 5 is a vertical section of a boat prior to the heat treatment of the food product.
Figure 6:
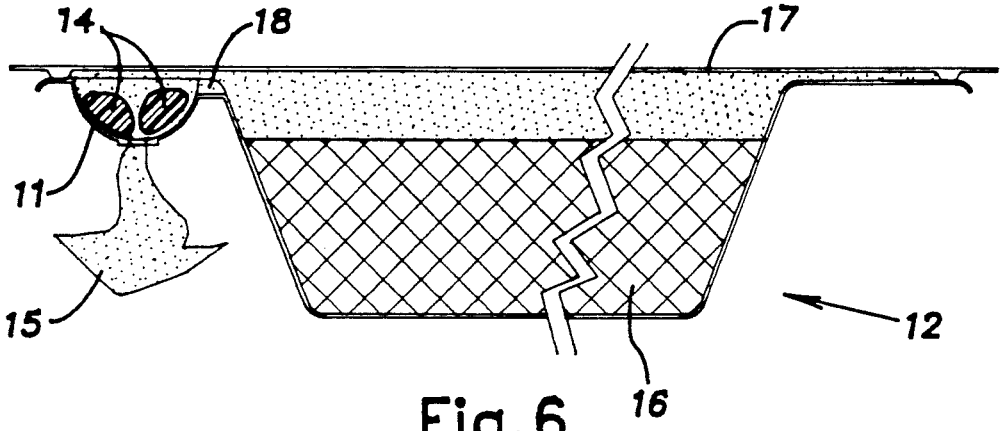
FIG. 6 is an analogous view of the boat during the heat treatment.
Figure 7:
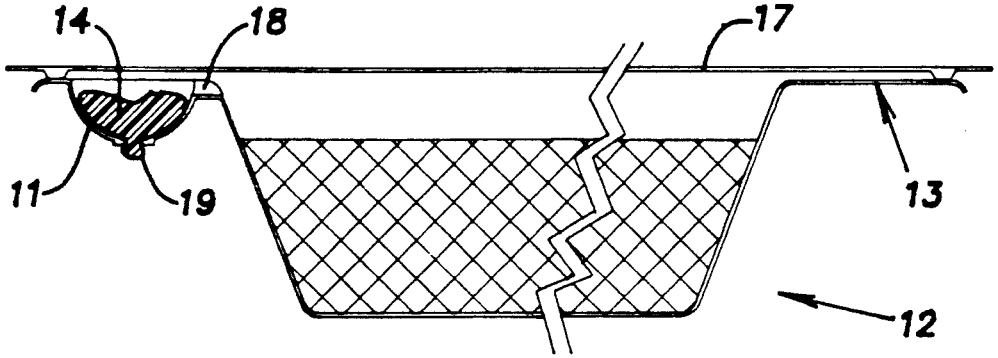
FIG. 7 is an analogous view after the heat treatment.

FIGS. 5 to 7 show a boat. It comprises a fusible valve formed by a housing 11 perforated in its lower part and formed in the horizontal edge 13 of the boat 12, advantageously in a corner or on the side. This seat receives a drop of fusible resin 14 at the time of manufacture, advantageously in a corner or on the side, said resin performing a function. When it melts, it allows for the passage of the undesirable gases 15 as well as the expanded hot air and the steam which escape during boiling as a result of the excess pressure created in the interior of the boat during boiling.

Once it has been filled with food products 16 disposed raw together with their ingredients, the boat is covered by a film 17 or a lid welded on to its periphery. Small channels 18 are provided in the thickness of the material forming the boat 12 so as to establish communication between the inner volume of the boat and the housing 11 of the fusible valve after sealing of the film 17.

In this manner, the air, the steam and the gases 15 can escape via the said channels and via the perforated housing during the boiling phase, the orifice of the housing 11 establishing communication between the interior of the boat 12 and the exterior when the drop of resin is in the liquid state (FIG. 6).

When boiling ends and cooling begins, the fusible resin sets once again, resulting in closure of the fusible valve (FIG. 3), thereby preventing the surrounding air from penetrating into the boat.

The vacuum created in the boat 12 as a result of the temperature difference increases the preserving properties of the food products, which are protected from the risk of oxidation. It is in this manner that, e.g. the colours of green vegetables are perfectly preserved.

I claim:

1. Empty container, including an upper part and an element integral with the upper part, a housing being defined by the upper part and by the element, said housing including first and second outlets and communicating with an interior region within the container via the first orifice and with an exterior region outside of the container via the second orifice, and a solid substance having a melting point between 65° C. and 150° C. contained in the housing.

2. Container according to claim 1, in which the second orifice has a circular cross section.

3. Container according to claim 2, in which the second orifice has a diameter between 0.7 and 2 mm.

4. Container according to claim 3, wherein the second orifice includes an outlet opening having a cross-sectional area in communication with the exterior region outside the container and the substance forms a rim having a cross-sectional area greater than that of the outlet opening of the second orifice.

5. Container according to claim 1, in which the housing adjoins the upper part of the container.

6. Container according to claim 1, in which the substance is present in the housing in a quantity of 10 to 100 mg.

7. Container according to claim 1, wherein the container is adapted to be filled with contents having a boiling point, and the substance has a viscosity of 6 Pas to 200 Pas at the boiling point of the contents of the container.

8. Container according to claim 1, in which the substance has a temperature interval between its melting point and its softening point of less than 15° C.

9. Container according to claim 1, in which the substance is an edible hot-melt adhesive.

10. Vacuum-sealed container, including contents and having an upper part and an element integral with the upper part, a housing defined by the upper part and by the element, the housing containing a solid substance having a melting point between 65° C. and 150° C. and including a first orifice communicating with an interior region within the container and a second orifice communicating with an exterior region outside the container the second orifice being adapted to be closed by the solid substance.

11. Container according to claim 10, in which the second orifice has a circular cross section.

12. Container according to claim 11, in which the second orifice has a diameter between 0.7 and 2 mm.

13. Container according to claim 10, wherein the second orifice includes an outlet opening having a cross-sectional area in communication with the exterior region outside the container and the substance forms a rim having a cross-sectional area greater than that of the second orifice at the outlet of the second orifice.

14. Container according to claim 10, in which the housing adjoins the upper part of the container.

15. Container according to claim 10, in which the substance is present in the housing in a quantity of 10 to 100 mg.

16. Container according to claim 10, wherein the container is adapted to be filled with contents having a boiling point, and the substance has a viscosity of 6 Pas to 200 Pas at the boiling point of the contents of the container.

17. Container according to claim 10, in which the substance has a temperature interval between its melting point and its softening point of less than 15° C.

18. Container according to claim 10, in which the substance is an edible hot-melt adhesive.

19. Process for the manufacture of a container having an upper part and a remaining part adapted to receive contents to be contained, comprising the sequential steps of providing a substance having a melting point between 65° C. and 150° C. in a housing defined in the upper part of the container that communicates with an interior region of the container via a first orifice and with an exterior region remote of the container via a second orifice, heating the container and its housing to a temperature at least equal to the melting point of the substance for 5 to 90 minutes, cooling the substance to a temperature lower than its melting point more rapidly than the remainder of the container and its contents, and cooling the remainder of the container and its contents to a temperature lower than or equal to ambient temperature.

* * * * *